US006015006A

United States Patent [19]

Cassels et al.

[11] Patent Number: 6,015,006

[45] **Date of Patent: *Jan. 18, 2000**

[54] CONTINUOUS CASTING MOULD

[75] Inventors: Ian Cassels, Sheffield; James Nicholas Cooper, Huddersfield, both of United Kingdom

[73] Assignee: Davy Distington Limited, Sheffield, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/913,019

[22] PCT Filed: Mar. 6, 1996

[86] PCT No.: PCT/GB96/00508

§ 371 Date: Oct. 23, 1997

§ 102(e) Date: Oct. 23, 1997

[87] PCT Pub. No.: WO96/27466

PCT Pub. Date: Sep. 12, 1996

[30] Foreign Application Priority Data

Mar. 7, 1995 [GB] United Kingdom ..... 9504528
Jan. 24, 1996 [GB] United Kingdom ..... 9601372

[51] Int. Cl.[7] ..... B22D 11/04

[52] U.S. Cl. ..... 164/416; 164/478

[58] Field of Search ..... 164/416, 478, 164/418

[56] References Cited

U.S. PATENT DOCUMENTS

| | | | |
|---|---|---|---|
| 3,881,544 | 5/1975 | Botta, Jr. et al. | 164/416 |
| 4,727,924 | 3/1988 | Dobinski et al. | 164/416 |

FOREIGN PATENT DOCUMENTS

| | | | |
|---|---|---|---|
| 0 732978B1 | 5/1997 | European Pat. Off. . | |
| 0 630605B1 | 6/1997 | European Pat. Off. . | |
| 939166 | 6/1982 | Russian Federation | 164/418 |

*Primary Examiner*—Kuang Y. Lin
*Attorney, Agent, or Firm*—Trexler, Bushnell, Giangiorgi & Blackstone, Ltd.

[57] ABSTRACT

A continuous casting mould comprises a fixed part (2) and a moveable part (1) and the latter includes means defining the mould passage. The moveable part is displaced relative to the fixed part generally in the direction of casting. The moveable part (1) is guided relative to the fixed part (2) by a plurality of guidance elements (4) each of which has a pair of opposit faces (6) which are arcuate convex form. The faces of each element are urged into abutting relation with cooperating surfaces on the fixed and moveable parts to allow rocking of the element relative to the surface.

16 Claims, 6 Drawing Sheets

CONTINUOUS CASTING MOULD

BACKGROUND OF THE INVENTION

This invention relates to continuous casting moulds and in particular to continuous casting moulds in which at least a part of the mould which includes means defining the mould passage can be oscillated in a direction which is substantially in the direction of casting.

A continuous casting mould for casting a metal strand, such as for example a slab, bloom, billet or a strand of round or more complex cross-section, can be a structure of considerable size, weight and complexity. In order to reduce the weight of the mould which has to be oscillated, it is known from EP-A-0325931 to form a movable mould part which includes means defining the mould passage and to arrange for this movable mould part to be oscillated with respect to a fixed part of the mould structure. The oscillated movable part has to be accurately guided for movement with respect to the fixed part of the mould structure.

SUMMARY

According to the present invention a mould for use in the continuous casting of a metal strand comprises

- a fixed mould part;
- a movable mould part which includes means defining the mould passage;
- means for displacing the movable mould part relative to the fixed part in a direction which is substantially in the direction of the casting axis of the mould passage; and is characterised by the provision of
  - a plurality of guidance elements for guiding the movable mould part relative to the fixed mould part, each element having a pair of opposite edges which are of arcuate convex form; and
  - means for urging said faces of each element into abutting relation with co-operating surfaces on the fixed and movable parts respectively, to allow rocking of the element relative to the surfaces.

It is convenient for the movable part of the mould and that includes the means defining the mould passage to be within the fixed part of the mould. However, the means which define the mould passage may be outside of the fixed part and secured to a structure which is within the fixed part. The guidance elements are then in abutting relation with surfaces on the fixed part of the mould and on the structure respectively.

The guidance elements have their faces urged into abutting relation with parallel surfaces on the fixed and movable parts and the urging means conveniently comprises at least one device which acts between the fixed and movable parts to urge the movable part towards the fixed part so that each guidance element is in contact with its cooperating surfaces. The device may take the form of a further guidance element comprising a plate having a pair of opposite faces which are of arcuate convex form and one of the faces abuts against a surface on the movable part and an adjustable-width spacer is positioned in abutting relation with the other of said faces and a surface on the fixed part. By adjusting the width of the spacer, the movable part can be urged in the direction or directions to remove clearances and/or apply compressive forces to the opposite faces of the other guidance elements.

Alternatively the device could be a spring or the like secured to the fixed and movable parts to urge the movable part towards the fixed part to remove clearances.

Each of the guidance elements must be free to rock on the surfaces against which the faces abut but it is important that the guidance elements are not allowed to slide or skew relative to the surfaces. To prevent sliding or skewing of the elements, each of the elements may be provided with two locating elements such as cylindrical pins, one at each end of the face. At each face of the element the two pins have a common longitudinal axis which is coincident with the line of contact between the element and the surface at the mid displacement position of the movable part of the mould. The two pins extend from opposite edges of the face of the plate. Each pin is mounted on a block which is bolted to one of the parts of the mould and the arcuate edges of the plate and the cooperating surfaces are partially cut-away to capture the pins with the axis of the pins being co-incident with the surface.

BRIEF DESCRIPTION OF THE DRAWINGS

In order that the invention may be more readily understood it will now be described, by way of example only, with reference to the accompanying drawings in which.

DETAILED DESCRIPTION OF THE INVENTION

A mould for use in the continuous casting of a metal strand such as a steel slab has provision for oscillating a displacement part of the mould passage in the general direction of casting during the casting operation.

Figure 1:
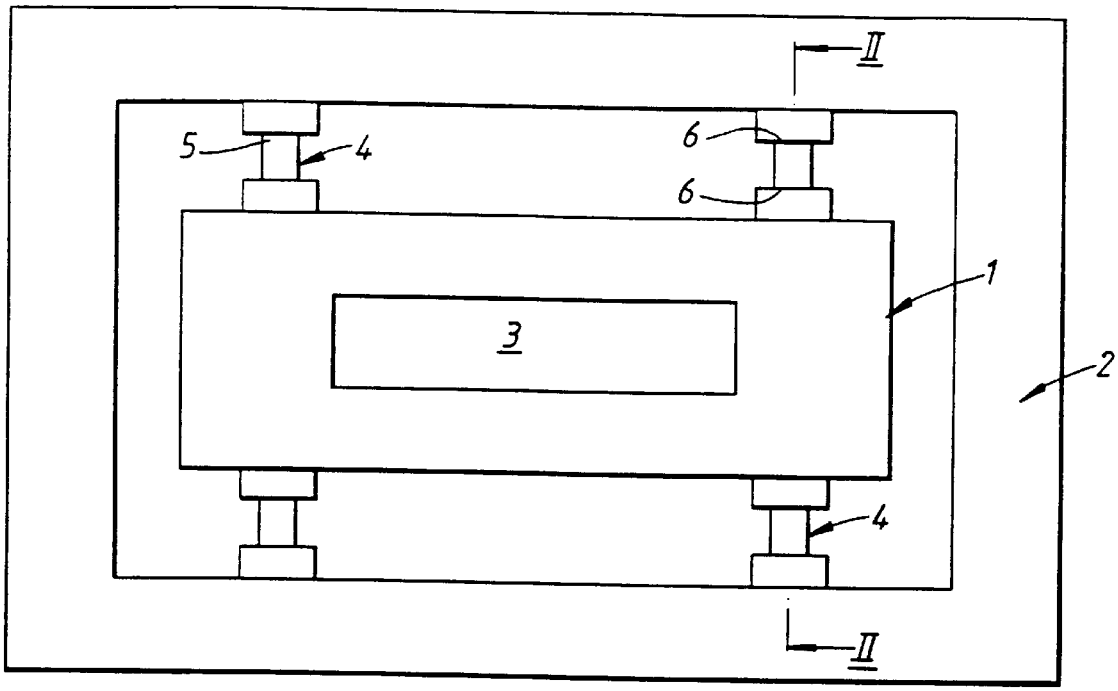
FIG. 1 is a plan view of a mould in accordance with the invention.
Figure 2:
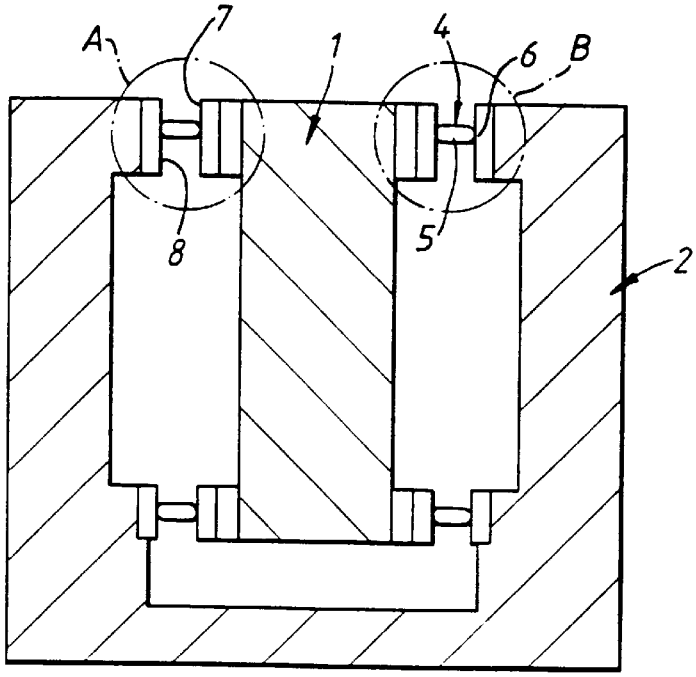
FIG. 2 is section on the line II—II of FIG. 1.
Figure 3A:
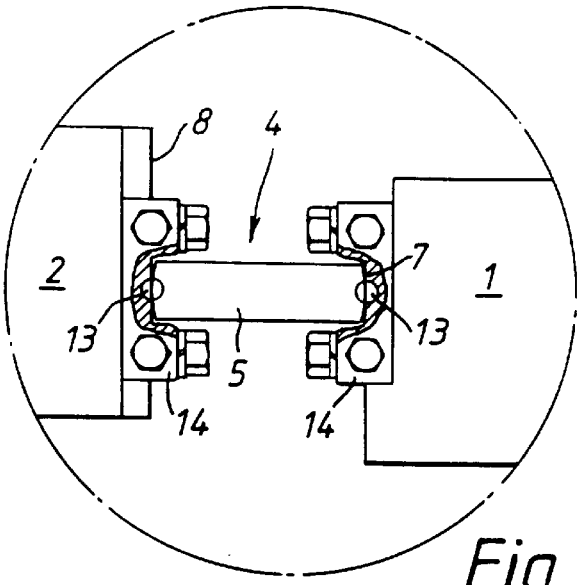
FIG. 3A is an enlargement of the detail A shown in FIG. 2.
Figure 3B:
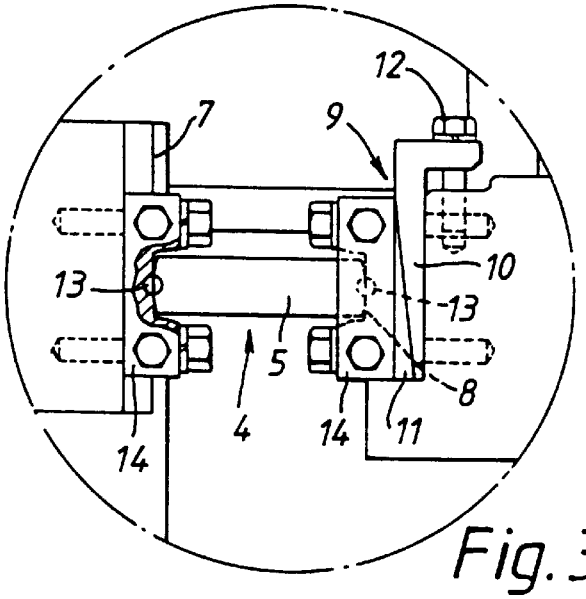
FIG. 3B is an enlargement of the detail B shown in FIG. 2.
Figure 3C:
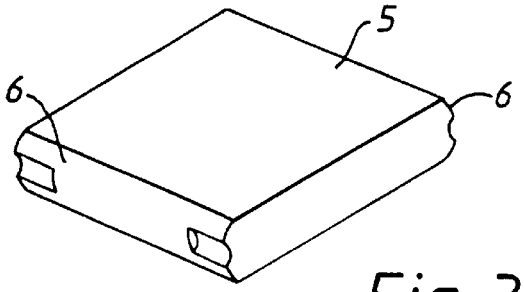
FIG. 3C is a perspective view of a guidance element.

Referring particularly to FIGS. 1 to 3, a continuous casting mould for casting a steel slab comprises a part 1 which is movable with respect to a fixed part 2. The part 1 includes a pair of "long" copper plates and a pair of "narrow" copper plates [neither plates being shown]. The narrow plates are within the long plates and rams (not shown) are provided for displacing the narrow plates within the long plates and for holding them in the required position. The long and narrow plates together define a mould passage 3 of generally rectangular cross-section and with the casting axis substantially vertical.

The longitudinal axis of the mould passage may be curved so that the casting axis curves away from the vertical but the general direction of the casting axis is vertical.

The copper plates are backed-up with water jackets and water is supplied to the rear of the copper plates for cooling purposes. The water jackets, the copper plates and the means for adjusting the position of the narrow copper plates are the major parts of the movable part of the mould and they may be designed as a cassette which can readily be replaced with an alternative cassette having different sizes of long and narrow copper plates.

The movable part 1 of the mould is located within and supported from the fixed part 2 which more or less surrounds the movable part. At each end of the mould there are at least two pairs of guidance elements 4 arranged at substantially 90° to the directions of casting. Each guidance element comprises an elongate flat metal plate 5 having a pair of opposite faces 6. These faces are of arcuate convex form and conveniently these faces comprise parts of a cylindrical surface. The respective edges are in rolling contact with a flat surface 7 on the movable part and with a flat surface 8, parallel to the surface 7, and located on the fixed part of the mould. the plates 5 are compressed to eliminate any clearances in the system. The guidance elements are arranged parallel to each other such that the movable inner part can be moved in a straight line normal to lines through the guidance element contact points when the system is at mid-stroke as shown in FIG. 2. The movable part 1 is oscillated by one or more oscillation imparting devices [not shown] such as controlled hydraulic cylinders, mechanical eccentric cams, electromagnetic devices or the like. A controlled hydraulic cylinder may be located at each end of the movable part of the mould, the cylinders acting between the movable and fixed parts. When the cylinders are energised, the movable part can be oscillated vertically in either a sinusoidal or non-sinusoidal manner to provide an amplitude of up to about 12 mm.

As indicated above, the movable part has to be accurately located with respect to the fixed part and the guidance elements should be compressed so that the arcuate faces are in abutting relation with the respective surfaces. As shown in FIG. 3B, a device for urging the faces 6 into abutting relation with the surfaces 7 and 8 comprises an adjustable width spacer 9. The spacer has a pair of tapered wedges 10 and 11 which are located between a surface of the fixed part of the mould and the surface 8 against which the guidance element abuts. A bolt 12 associated with one of the wedges permits the wedge to be moved relative to the other wedge to vary the separation between the surfaces and eliminate clearances. Each guidance element may have a separate adjustable width spacer associated with it but alternatively, only those guidance elements on one side of the movable part of the mould may be provided with adjustable width spacers.

The clamping of the long faces of the mould is maintained by means such as disc springs and the clamping force can be relieved for width adjustment using hydraulic cylinders. The slab width can be changed during casting using a drive arrangement mounted in the narrow plates of the mould so that square or rectangular slabs can be cast.

Each of the guidance elements must be free to rock on the vertical surfaces against which the faces of the plate 5 abut and it can be seen from FIG. 3 that the guidance elements will be inclined as the inner part of the mould is displaced relative to the outer part. It is important however that the guidance elements are not allowed to skew or slip relative to the vertical surfaces. To avoid skewing or slipping of the elements, each of said faces of each element is provided with two cylindrical pins 13, one at each end of the face. At each face of the element the two pins 13 have a common longitudinal axis which is coincident with the line of contact between the element and the vertical surface in the mid stroke position. The two pins extend from opposite ends of the face of the plate. Each pin is mounted in a block 14 which is bolted to the inner or outer part of the mould and the arcuate edges of the plate are partially cut-away to capture the pins with the axis of the pins being coincident with the vertical surface. In this way the pins are located relative to the inner or outer part of the mould and the plate forming the guidance member is rockable about the pins.

Figure 4:
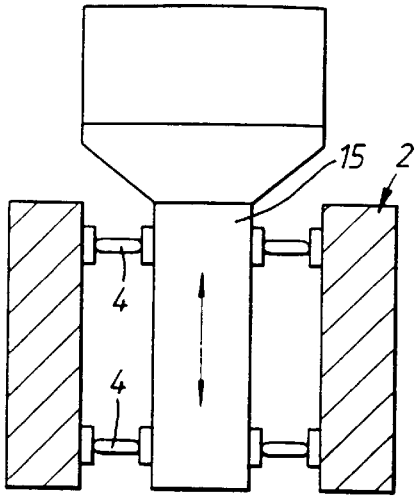
FIGS. 4, 5, 6 and 16 are diagrammatic side elevations of alternative forms of mould in accordance with the invention.
Figure 5:
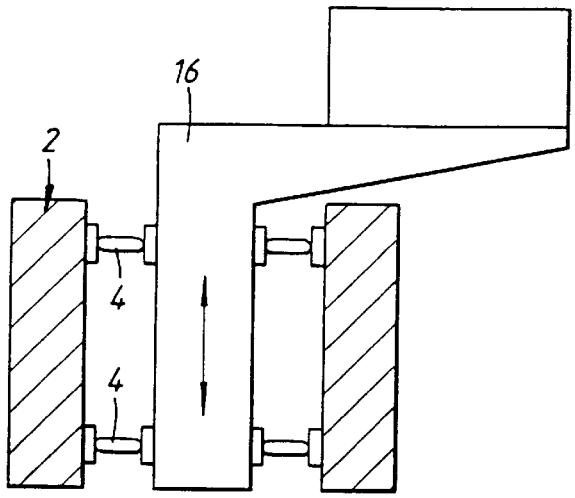
Figure 6:
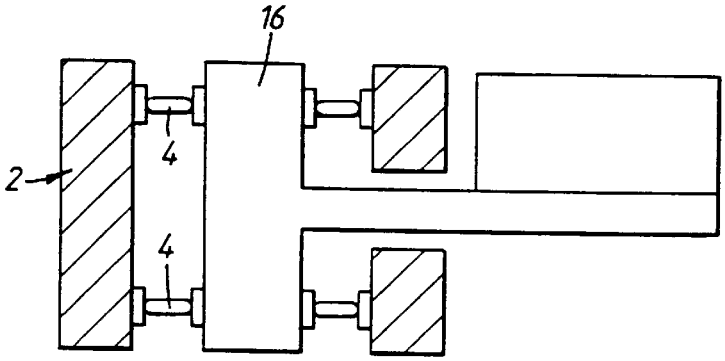
Figure 16:
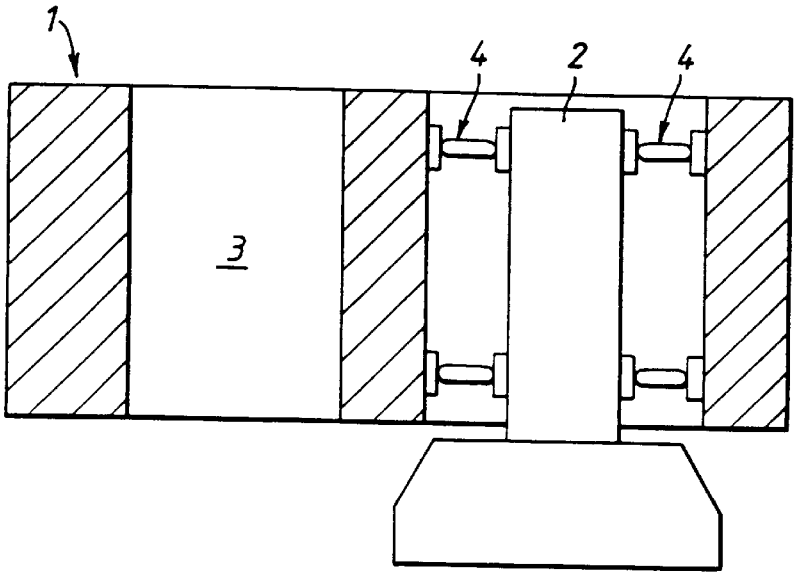

It is not essential for the part of the mould which defines the mould passage to be within the fixed part of the mould. In the arrangement shown in FIG. 4 the part of the mould which defines the mould passage 3 is located above the fixed part of the mould. This part is mounted vertically above a structure 15 and the structure is guided within the fixed part 2 of the mould. In the arrangements shown in FIGS. 5 & 6, the mould passage 3 is defined by a part which is offset from the fixed part of the mould. In both of these arrangements this part is secured to a structure 16 which is guided within the fixed part of the mould, whereas in the FIG. 16 arrangement the structure is guided around the fixed part. Oscillation of the structure in the vertical direction will cause vertical oscillation to be applied to the part defining the mould passage.

Figure 7:
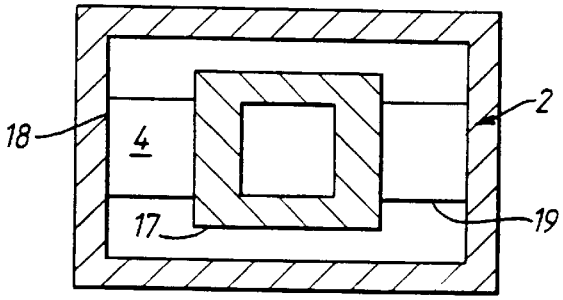
FIGS. 7, 8 and 9 are sectioned plan views of alternative forms of mould in accordance with the invention.

FIG. 7 shows a mould where a mould cavity of generally square cross-section is defined by a movable part 17 of the mould and this part is located within the fixed part. The fixed part has a vertical surface 18 which acts as a datum surface and a pair of guidance elements 4 of the form described above act one above the other between this datum surface and a parallel vertical surface on the moving part. At the opposite side of the movable part 17 of the mould a pair of elements 19 act one above the other between the movable part and the fixed part and serve to urge the movable part towards the datum surface 18 thereby removing clearances between the faces & surfaces.

Figure 8:
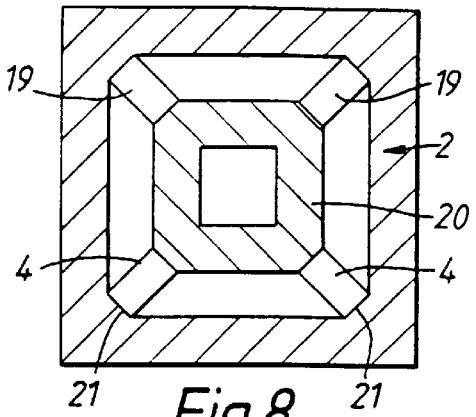
Figure 9:
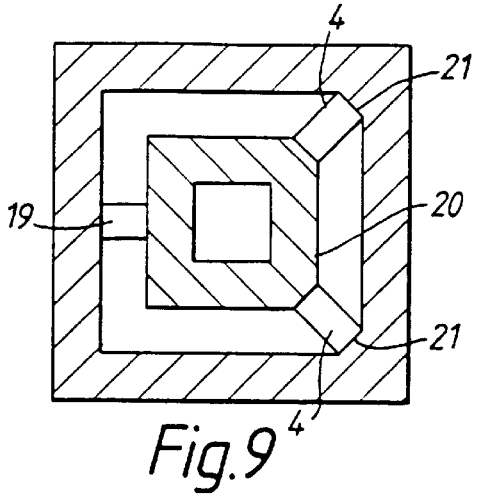

Similarly, in the arrangement shown in FIG. 8, the movable part 20 of the mould is of generally square cross-section and it is located within a fixed mould part 2 of generally square cross-section. At each of a pair of adjacent corners of the fixed mould part there is a vertical datum surface 21 which is at 45° to the side walls of the mould part. At the corresponding corners of the inner mould part there are also vertical surfaces and a pair of guidance elements 4 one above the other act between the datum surface and the corresponding surfaces on the movable part of the mould. At the other pair of corresponding corners of the inner and outer mould parts there are guidance devices 19 which urge the movable part of the mould towards the datum surfaces to remove clearances between the faces & surfaces. A similar arrangement is shown in FIG. 9 where there are two guidance elements 4 at a pair of adjacent corners and one device 19 for urging the movable part of the mould towards the datum surfaces 21 on the fixed mould part.

Figure 10:
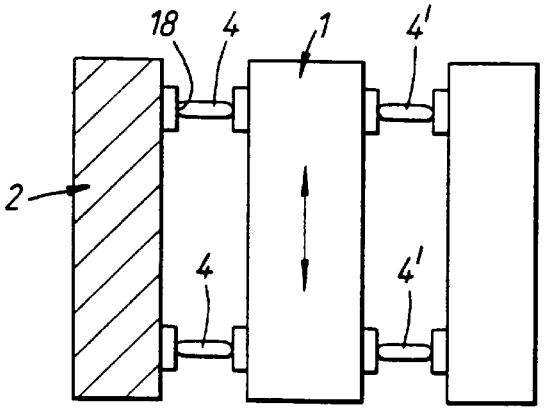
FIGS. 10 to 14 are diagrammatic side elevations of a mould showing alternative forms of construction.
Figure 11:
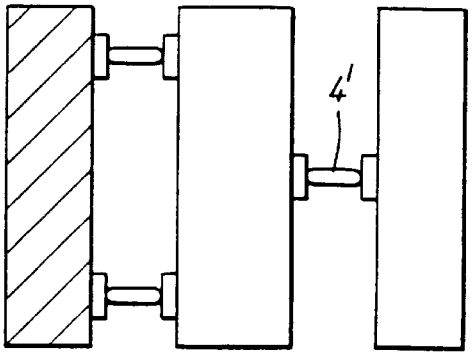
Figure 12:
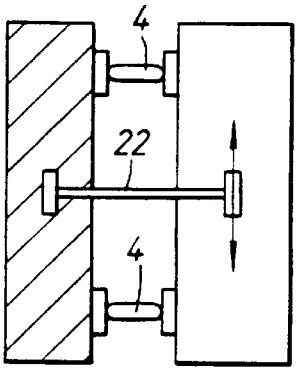

FIGS. 10 to 14 illustrate various embodiments where different devices are used to urge the movable part towards the datum surfaces 18 on the fixed part. In each of these figures, the fixed part of the mould provides a vertical flat datum surface 18. At least two guidance elements 4 are associated with this datum surface. Each element has one arcuate face abutting against the datum surface and the opposite arcuate face abutting against a vertical surface on the movable part of the mould. In FIG. 10 there are shown two further guidance elements 4' which also have provision [not shown] for urging the movable part towards the datum surface. In the FIG. 11 arrangement there is only one guidance element which has provision for urging the movable part towards the datum surface. A simpler arrangement is shown in FIG. 12 where one or more tension members 22, such as leaf springs, are connected to the fixed and movable part to urge the movable part towards the datum surface.

Figure 13:
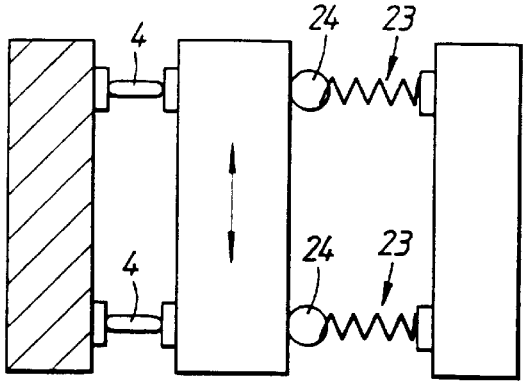
Figure 14:
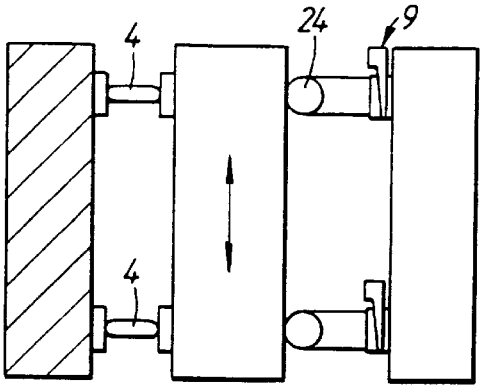

In the FIG. 13 arrangement the means for urging the movable part towards the datum surface comprise a pair of elements 23 including spring loaded rollers 24 which are in contact with the movable part on the side thereof opposite the datum surface. These spring loaded devices may also have adjusting devices in series with them, the adjusting devices may take the form of tapered wedges 9 as shown in FIG. 14.

Figure 15:
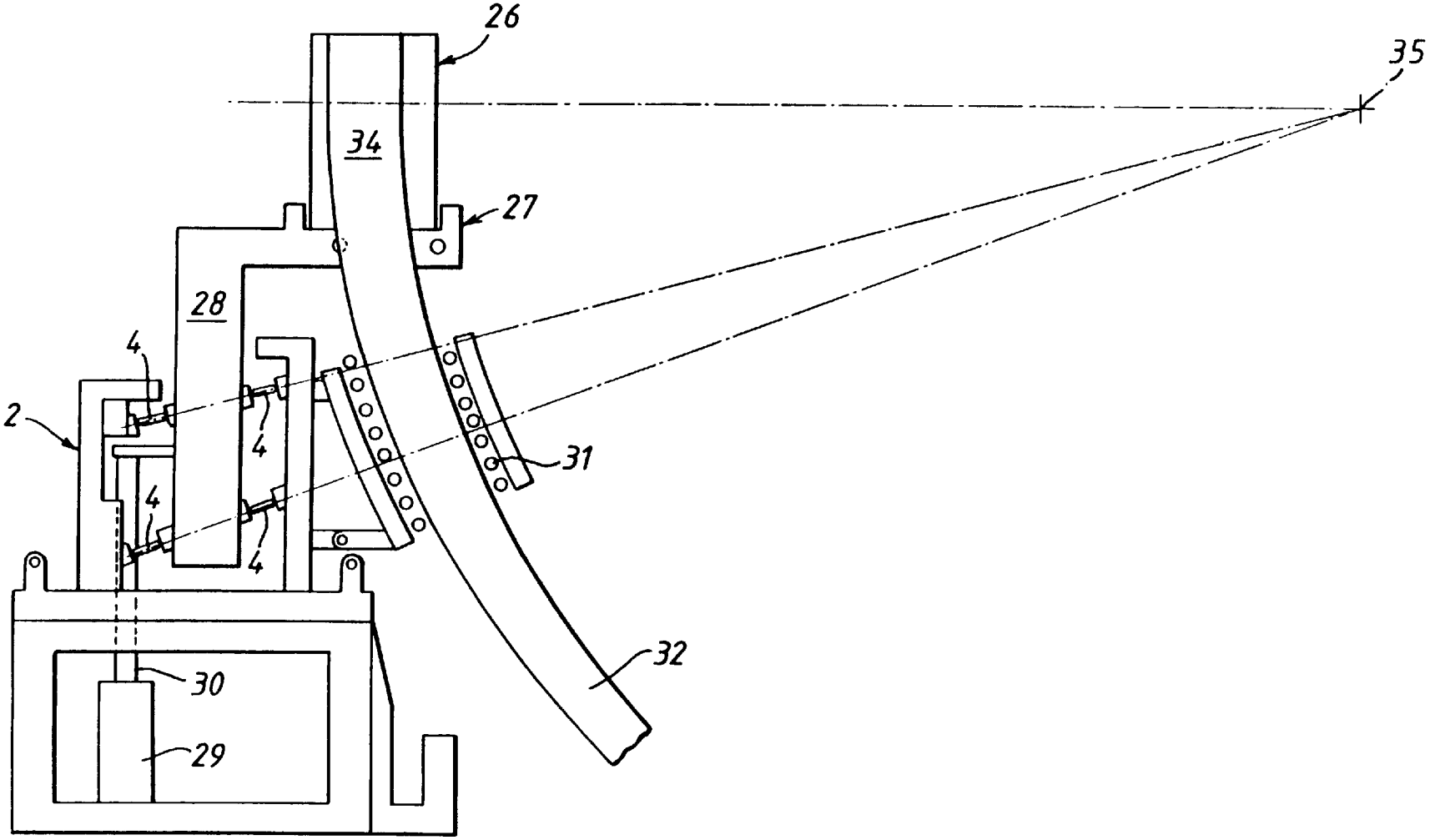
FIG. 15 is a diagrammatic side elevation of a mould for use in the continuous casting of a metal strand such as a bloom.

FIG. 15 illustrates a typical construction for the continuous casting of a steel bloom. The mould passage 34 is generally vertical but it is slightly curved out of the vertical plane. This is well known in the continuous casting art. The part of the mould 26 which defines the mould passage is positioned on a substantially horizontal bracket 27 which in turn is secured to a vertical structure 28 which is guided by means similar to that shown in FIG. 10 but any of the means described above could be employed. An oscillator device 29 is mounted on the fixed part of the mould and has a vertically extending rod 30 which is secured to the structure 28. When the oscillator is energised, the rod is caused to oscillate in the vertical direction and this movement is applied to the structure which is caused to oscillate, whilst guided, within the fixed part of the mould. The vertical oscillation of the structure causes the mould part 26 and the mould passage to be oscillated along substantially the same path as the direction of casting.

Below the bracket there are sets of rollers 31 for guiding the casting 32 emerging from the mould passage and passing through the bracket. To achieve the required path of oscillation of the mould passage each guidance element 4 is so arranged that a straight line connecting the line of contact of each of its faces 6 with the co-operating surfaces 7 and 8 also intersects the centre of curvature 35 of the mould passage 34 when the movable part is at its mid displacement position relative to the fixed part. Ideally the surfaces on the fixed and moving parts would be curved with a centre of curvature coincident with the centre of curvature of the mould passage 34. However, in practice, flat surfaces may be used which are tangential to the ideal curved surfaces at the mid displacement position with only a small inconsequential geometric inaccuracy.

We claim:

1. A mould assembly assembly for use in the continuous casting of a metal strand comprising a fixed mould part (2);

a movable mould part (1, 15, 16, 17, 20, 26) which includes means defining the mould passage (3);

means for displacing the movable mould part relative to the fixed mould part in a direction which is substantially in the direction of casting;

a plurality of guidance elements (4) for guiding the movable mould part relative to the fixed mould part, each element (4) having a pair of opposite faces (6) which are of arcuate convex from, with one face (6) of each said element (4) in engagement with a surface of said fixed mould part (2), and with the other face (6) of each said element (4) in engagement with a surface of said movable mould part (1, 15, 16, 17, 20, 26); with each of said faces (6) of each of said guidance elements (4) retained in contact with said surface against which they abut by means (13) which permit said guidance elements (4) to rock relative to sad surface as said movable mould part is displaced during casting; and means (9, 23, 24) for urging said faces (6) of each element (4) into abutting relation with co-operating surfaces (7, 8) on the fixed and movable mould parts respectively, to allow rocking of the element (4) relative to the surfaces.

2. A mould assembly as claimed in claim 1 characterised in that the means which define the mould passage (3) is within the fixed mould part (2).

3. A mould assembly as claimed in claim 1 characterised in that the means (26) which define the mould passage (34) is outside of the fixed mould part (2) and is secured to a structure (28) which co-operates with the fixed mould part, and said faces (6) of each of said elements (4) are in abutting relation with surfaces (8) on the fixed mould part and the structure respectively.

4. A mould assembly as claimed in claim 1 characterised in that the means for urging the faces (6) of each element (4) into abutting relation with co-operating surfaces (7, 8) on the fixed and movable mould parts respectively comprises at least one device (9, 19, 22, 23, 24) acting between the fixed and movable mould parts and urging the movable mould part (1) towards the fixed mould part (2).

5. A mould assembly as claimed in claim 4 characterised in that said device comprises a further guidance element (4) having a pair of opposite faces (6) which are of arcuate convex form, one of said faces abutting against a surface (7) on the movable mould part (1) and an adjustable width spacer (9) positioned in abutting relation with the other of said faces (6) and a surface on the fixed mould part (2).

6. A mould assembly as claimed in claim 4 characterised in that said device comprises a tension member (22) secured to the fixed and movable mould parts.

7. A mould assembly as claimed in claim 4 characterised in that said device comprises a spring loaded roller (24) acting between the fixed and movable mould parts.

8. A mould assembly as claimed in claim 4 characterised in that said device comprises a roller (24) in side-by-side relation with an adjustable width spacer (9) and acting between the fixed and movable mould parts.

9. A mould assembly as claimed in claim 1 characterised in that the means defining the mould passage comprise a first pair of plate structures and a second pair of plate structures which together define a mould passage of substantially square or rectangular cross-section.

10. A mould assembly as claimed in claim 9 characterised in that there are four pairs of said guidance elements (4), two pairs of elements being located at each of the opposite ends of the first pair of plate structures and the two pairs of elements at each end of the first plate structures being arranged one pair above the other.

11. A mould assembly as claimed in claim 10 characterised in that each of the further guidance elements (4) associated with one of the first pair of plate structures has an adjustable width spacer (9) located between the face (6) of the guidance elements and an adjacent surface of the fixed mould part (2).

12. A mould assembly as claimed in claim 11 characterised in that the adjustable width spacer (9) is between the face (6) of the further guidance element (4) and the adjacent surface of the fixed mould part.

13. A mould assembly as claimed in claim 1 characterised in that said abutting means (13) comprises a semi-circular recess in each said surface, against which said faces (6) abut, a co-operating half recess in said faces and a locating element which is captured between said semi-circular recesses.

14. A mould assembly as claimed in claim 1 characterised in that the mould passage (34) is curved, and in that at the mid-displacement position of the movable mould part relative to the fixed mould part, for each guidance element (4) a straight line intersecting the line of contact of each of said faces with the co-operating surface also intersects the centre of curvature (35) of the mould passage.

15. A mould assembly as claimed in claim 1 characterised in that each guidance element (4) comprises a flat plate (5) having opposite edges (6) which constitute said opposite faces.

16. A mould assembly as claimed in claim 13, wherein said locating element is a pin.

* * * * *